United States Patent [19]

Cawston et al.

[11] Patent Number: 4,735,169

[45] Date of Patent: Apr. 5, 1988

[54] ADHESIVE APPLICATOR ASSEMBLY

[75] Inventors: James D. Cawston; Theodore M. Hadzimihalis, both of Marietta; Bruce G. Dieringer, Norcross, all of Ga.

[73] Assignee: Nordson Corporation, Amherst, Ohio

[21] Appl. No.: 903,465

[22] Filed: Sep. 3, 1986

[51] Int. Cl.[4] ..... B05C 5/02

[52] U.S. Cl. ..... 118/411; 118/DIG. 3; 425/467

[58] Field of Search ..... 118/410, 411, DIG. 3; 425/467, 113; 239/596, 597, 600

[56] References Cited

U.S. PATENT DOCUMENTS

| | | | |
|---|---|---|---|
| 2,175,961 | 10/1939 | Kampfer | 118/410 |
| 4,023,526 | 5/1977 | Ashmus et al. | 118/410 |
| 4,051,807 | 10/1977 | Graf et al. | 118/410 X |
| 4,299,186 | 11/1981 | Pipkin et al. | 118/410 X |
| 4,476,165 | 10/1984 | McIntyre | 118/411 X |
| 4,557,217 | 12/1985 | Zingg | 427/420 |

OTHER PUBLICATIONS

Internal Nordson drawing of a slot nozzle, (1981).

Nordson Heated Slot Nozzle Bulletin, No. 26, (Nov., 1980).

Internal Nordson Drawing of an LTI Slot Nozzle, Feb. 11, 1985.

Internal Nordson Drawing of a Slot Nozzle, (1979).

*Primary Examiner*—John P. McIntosh

*Attorney, Agent, or Firm*—Wood, Herron & Evans

[57] ABSTRACT

An applicator assembly for applying hot melt adhesive to a substrate such as the end flaps of a sift-proof carton includes slot nozzles employing elongated, wear-resistant doctor blades formed with a fluid discharge slot. The doctor blades, preferably in the form of hardened steel plates, are releasably clamped to the body of the applicator in communication with the outlet of an internal passageway in the applicator body which receives adhesive from a flow control device such as an adhesive gun. The plates forming the doctor blades are separated by a shim to define the fluid discharge slot into which the adhesive flows from the internal passageway. The lowermost ends of the doctor blades are formed in various configurations to spread the adhesive in the desired pattern or thickness on the substrate depending upon the type of adhesive employed or the requirements of a given application.

11 Claims, 4 Drawing Sheets

ADHESIVE APPLICATOR ASSEMBLY

BACKGROUND OF THE INVENTION

This invention relates to adhesive applicators, and, more particularly, to an applicator for dispensing hot melt adhesive onto a substrate such as the end flap structure of sift-proof cartons.

Hot melt thermoplastic adhesives are commonly used in applications such as packaging and cartoning where the quick setting time of this type of adhesive is advantageous. Hot melt adhesive applied to the flaps of a carton sets relatively quickly and substantially reduces the time in which compressive forces must be applied to the flaps while the adhesive bonds.

One type of cartoning application in which hot melt adhesives have proven effective is in bonding of the end flaps of sift-proof cartons. The hot melt adhesive pattern applied to the end flap structure of sift-proof cartons commonly includes a total of five discreet ribbons or strips of adhesive to effect a sift-proof seal. In order to provide a continuous line or bead of adhesive along the carton edge and prevent the formation of any minute channels or openings through which granular material in the carton could leak, the adhesive pattern must be accurately applied to the flap structure. This has been achieved in the prior art by mounting multiple adhesive guns above the path of the cartons and positioning the nozzles of the guns so that they contact the flap structures of the cartons. Direct contact between the nozzles of the adhesive guns and flaps ensures accurate placement of each of the five separate strips of adhesive.

One problem with this practice in the prior art is that of abrasion of the adhesive gun by the carton flaps. Nozzles are often fabricated of a relatively soft metal, such as cast aluminum or a similar lightweight metal, which has poor wear resistance. After a relatively short period of use, contact of such soft metal nozzles with the flaps results in abrasive wear which can distort the size and/or shape of the discharge orifice of the nozzle, and, in turn, the ribbon or strip of adhesive dispensed from the nozzle.

Another problem with prior art applicators for dispensing adhesives onto the flaps of sift-proof cartons, or other types of substrates, is that the vertical position of one adhesive gun relative to another is not readily adjustable to accommodate surfaces of different height. The desired vertical adjustment is not possible in some prior art adhesive applicators; in others it requires expensive modification of the gun.

SUMMARY OF THE INVENTION

It is therefore among the objectives of this invention to provide an applicator assembly for applying hot melt adhesive to a substrate, such as the end flap structure of a sift-proof carton, which is resistant to wear occasioned by contact with the substrate, which provides for vertical adjustment of the position of one or more dispensing nozzles relative to another and which provides for replacement of worn dispensing nozzles with minimum cost and effort.

These objectives are accomplished in an adhesive applicator in which elongated strips of adhesive are applied to a substrate by a wear-resistant slot nozzle assembly. The slot nozzle assembly includes one or more doctor blades, preferably made of hardened steel, which are formed with an elongated slot having a discharge end adapted to contact the substrate. The doctor blades are releasably clamped onto the body of the applicator in fluid communication with flow control devices, such as adhesive guns, connected to a source of hot melt adhesive. Hot melt adhesive from the source is directed by the adhesive guns into the elongated slot of the doctor blades for application directly onto the substrate. The hardened steel forming the doctor blades is much more resistant to wear than soft metals such as cast aluminum, and the doctor blades are easily unclamped from the applicator body for replacement.

In a preferred embodiment of this invention, the adhesive applicator comprises an applicator body formed with an internal passageway terminating in an outlet port. Doctor blades formed with an elongated fluid discharge slot are mounted to the applicator body by a clamp so that the outlet port of the internal passageway communicates with the discharge slot in the blades. An adhesive gun is connected to an adhesive supply passageway formed in the applicator body, which, in turn, is connected to a source of adhesive. The adhesive gun communicates with the inlet of the internal passageway for controlling the flow of hot melt adhesive into the discharge slot of the doctor blades. The doctor blades contact the substrate and spread the hot melt adhesive therealong to obtain a ribbon or strip of adhesive having the desired shape and/or thickness.

Alternative embodiments of the doctor blades of this invention are provided for contacting the substrate and spreading the hot melt adhesive in a desired pattern. The doctor blades, preferably in the form of one or more elongated plates of tool steel or other hardened metal, are formed with an elongated fluid discharge slot adapted to communicate with the outlet port of the internal passageway in the applicator body. The lowermost ends of the doctor blades are formed with a flat surface, an angled surface or a combination of both depending upon the viscosity of the particular hot melt adhesive used and the pattern or thickness of the adhesive strip required for a particular application.

In a preferred embodiment, the doctor blades include a first blade having a longitudinal slot, a second blade and a shim connected between the first and second blades to form a space therebetween defining an elongated fluid discharge slot. The first and second blades and shim are fastened together by two flat head screws in a countersunk slot which allows the front blade to be positioned lower than the shim or rear blade. The blades and shim are clamped as a unit to the applicator body so that the longitudinal slot of the first blade communicates with the outlet port of the internal passageway in the applicator body.

Alternatively, two doctor blades are provided each having planar surfaces. A cut-out extends inwardly from the planar surface of at least one of the blades so that when the blades are connected together a space is formed between their planar surfaces defining an elongated fluid discharge slot. A longitudinal slot is formed in the blade with the cut-out, generally perpendicular to the elongated fluid discharge slot, which communicates with the outlet port of the internal passageway when the blades are clamped to the applicator body.

In a still further embodiment, a single doctor blade is employed having a planar surface adapted to be clamped against the applicator body over the outlet port of the internal passageway. A cut-out or recess is formed in the doctor blade from its planar surface inwardly which defines an elongated fluid discharge slot.

The plate or plates forming the doctor blades of this invention are preferably formed of tool steel or other hardened metal to reduce the wear caused by the contact of their lowermost ends with the flaps of cartons or other substrates which receive the hot melt adhesive. Doctor blades formed from such plates last much longer than the cast aluminum nozzles employed in prior art applicators for carton fabrication. In addition, the blades are easily removed from the applicator body by loosening the clamp which holds them thereto, removing the blades and inserting a new set. The applicator body and all other elements of the assembly can be formed of cast aluminum to reduce weight without being subjected to wear as in the prior art.

The doctor blades in each of the embodiments described above are clamped to the applicator body in position below a threaded bore formed in the applicator body. A set screw rotatable within the threaded bore is adapted to contact the top of the doctor blades and adjust their vertical position with respect to the applicator body. In this manner, the vertical position of the lowermost end of the doctor blades may be adjusted to contact substrate of different heights to ensure accurate placement of adhesive thereon.

In another aspect of this invention, an adhesive applicator assembly which employs doctor blades of the type described above is specifically adapted for applying hot melt adhesive to the end flap structure of a four-sided sift-proof carton. In this embodiment, first and second adhesive guns are carried side-by-side on the body of the applicator assembly and supply adhesive to one set of elongated doctor blades which align with the outer major flap and a portion of the minor flaps of a four-sided, sift-proof carton. Such doctor blades apply a strip of adhesive to each end of the outer major flap and an adjacent portion of the minor flaps. A third adhesive gun, laterally spaced on the front of the applicator body from the pair of adhesive guns, supplies adhesive to a second set of doctor blades. The set of doctor blades supplied by the third adhesive gun align with the inner major flap of the carton for application of strips of adhesive to the ends of such flap.

A fourth adhesive gun is mounted on the applicator body behind the first and second guns in alignment with the outer major flap of the carton. The fourth adhesive gun employs a standard slot nozzle which is adapted to apply a flat bead of adhesive longitudinally along the outer major flap between the strips of adhesive at the ends of the outer major flap.

DESCRIPTION OF THE DRAWINGS

The structure, operation and advantages of a presently preferred embodiment of this invention will become further apparent upon consideration of the following description, taken in conjunction with the accompanying drawings, wherein.

DETAILED DESCRIPTION OF THE INVENTION

Figure 1:
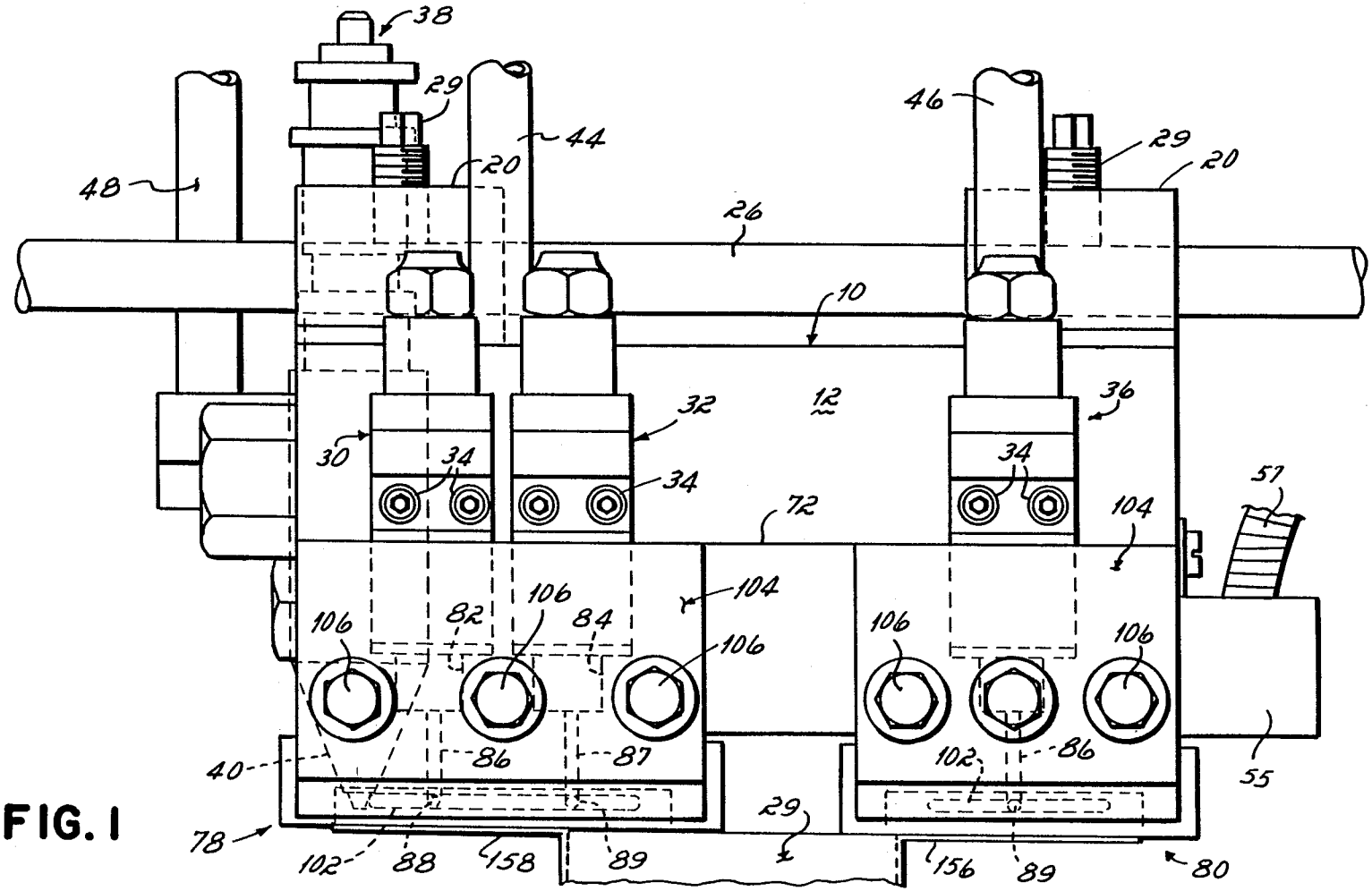
FIG. 1 is a front view of the adhesive applicator assembly of this invention.
Figure 2:
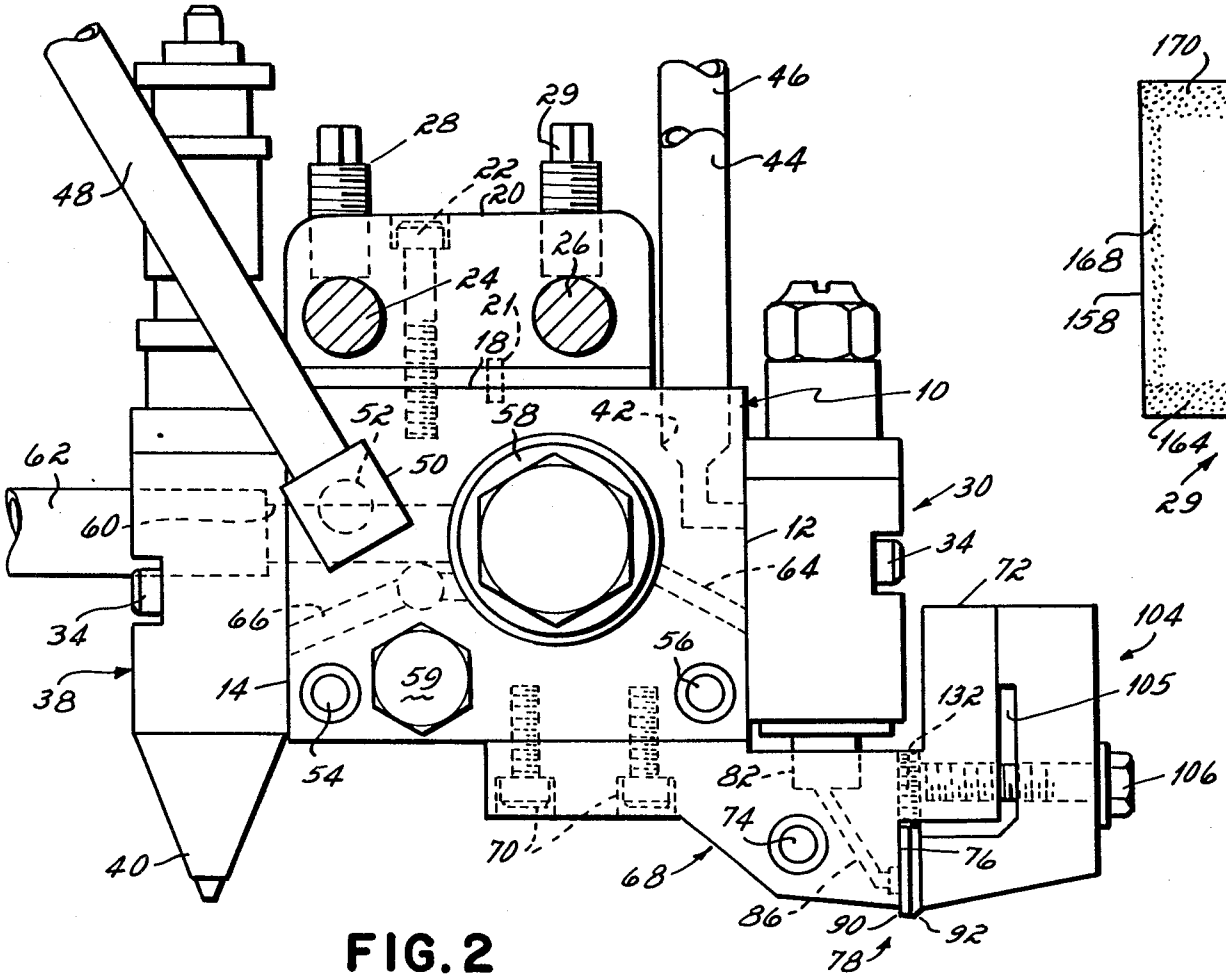
FIG. 2 is a side view of FIG. 1.

Referring to FIGS. 1 and 2, the adhesive applicator assembly of this invention includes an applicator body 10 having a front face 12, rear face 14, bottom face 16 and top face 18. A pair of laterally spaced support blocks 20 are mounted to the top face 18 of applicator body 10 by screws 22, one of which is shown in FIG. 2. The support blocks 20 are carried by a pair of rods 24, 26 to permit lateral adjustment of the position of applicator body 10 as desired. Set screws 28, 29 extend through the top of each support block 20 into engagement with the rods 24, 26, respectively, to secure the applicator body 10 in the desired lateral position, and roll pins 21 extend between the support blocks 20 and applicator body 10 to prevent movement therebetween.

In a presently preferred embodiment of this invention for applying hot melt adhesive to the end flap structure of a four-sided, sift-proof carton 29, described in detail below, four adhesive guns are employed. As best shown in FIG. 1, a pair of adhesive guns 30, 32 are mounted side by side to the front face 12 of applicator body 10 by mounting screws 34. A third adhesive gun 36 is also mounted to the front face 12 of applicator body 10, laterally spaced from adhesive guns 30, 32, which is secured in place by mounting screws 34. A fourth adhesive gun 38 having a nozzle 40 is mounted to the rear face 14 of applicator body 10 by mounting screws 34, generally behind the front pair of adhesive guns 30, 32. See FIG. 2.

In a presently preferred embodiment, the adhesive guns 30, 32, 36 and 38 are Model H200, air piloted guns commercially available from the assignee of this invention, Nordson Corporation of Amherst, Ohio. It is contemplated, however, that other commercially available guns would be suitable for use in the adhesive applicator assembly of this invention. As described in more detail below, the adhesive guns function to control the flow of hot melt adhesive into a discharge slot from which it is applied onto the end flaps of a carton or other substrate.

The supply of operating air and adhesive to each of the guns 30, 32, 36 and 38, is best shown in FIG. 2. An internal air passageway 42 is formed in the applicator body 10 between its top face 18 and front face 12 which connects both of the adhesive guns 30, 32 to an air supply line 44 from a source of pressurized air (not shown). A second internal air passageway (not shown) is formed in the applicator body 10 to transmit pressurized air from a supply line 46 into the third adhesive gun 36 on the front face 12 of applicator body 10. The remaining adhesive gun 38 is piloted by air supplied via an air line 48 connected by a pipe fitting 50 to an internal passageway 52 formed in the applicator body 10. The flow of operating air through lines 42 and 46 to pilot guns 30–38 is controlled by a solenoid valve or other conventional control device (not shown), which opens and closes the guns 30–38 at the desired intervals in a known manner.

As illustrated in FIG. 2, adhesive is supplied to the guns 30–38 from a main adhesive supply passageway 60 formed in applicator block 10, which is connected by an outlet line 62 to a source of adhesive (not shown). A filter 58 is mounted in the supply passageway 60, upstream from each of the guns 30–38, to filter the adhesive before it is applied to a substrate. Adhesive is supplied to the front pair of adhesive guns 30, 32 from the filter 58 and supply passageway 60 via a connector passageway 64. A second adhesive connector passageway (not shown) extends between the third adhesive gun 36 and the filter 58. The fourth adhesive gun 38 is supplied with adhesive through another connector passageway 66 formed in the applicator body 10 which is connected to supply passageway 60 through filter 58.

A drain 59 connected to return passageway 60 is also provided to remove char and contaminants from the applicator body 10 when the filter 58 is changed or during other periods when the applicator assembly is non-operational. Heaters 54, 56 are provided in the applicator body 10 to aid in maintaining the adhesive at proper temperature so that it remains in a flowable state. The heaters 54, 56 are wired from a junction box 55 mounted to the applicator body 10, which is connected by an electric cable 57 to a source of power (not shown).

Figure 4:
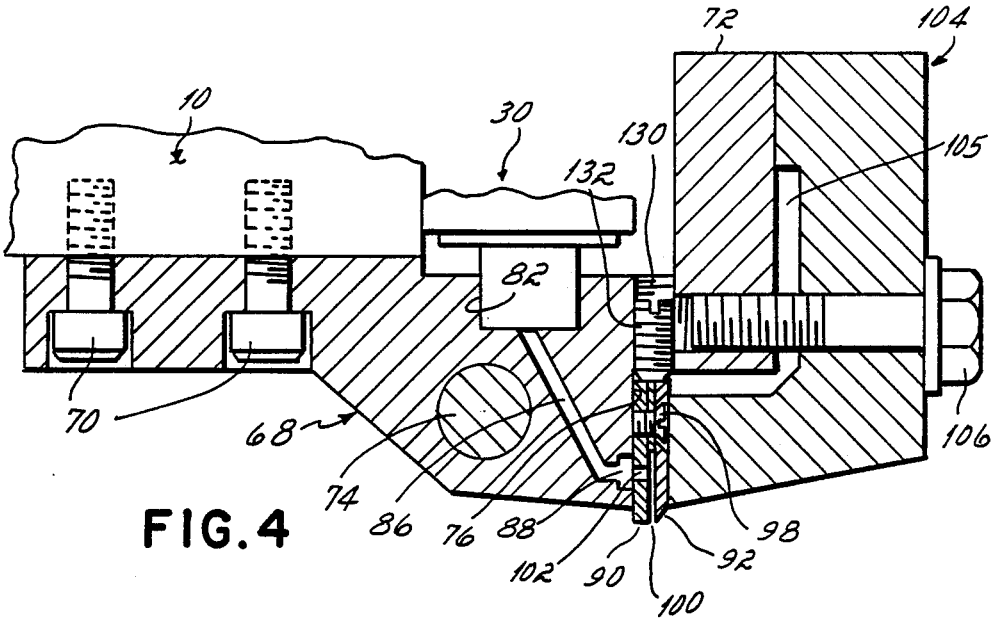
FIG. 4 is an enlarged cross sectional view of one embodiment of the doctor blades and clamping arrangement of this invention.

Referring now to FIGS. 1 and 4, a base plate 68 is mounted to the bottom face 16 of applicator body 10 by screws 70. The forward portion of the base plate 68 is formed with an upright leg 72 which extends laterally along the width of the applicator body 10 immediately in front of the adhesive gun pair 30, 32 and the third adhesive gun 36. The base plate 68 also includes a heater 74 to maintain temperature in the hot melt adhesive flowing therethrough as described below.

As best shown in FIG. 1, laterally spaced slot nozzle assemblies 78 and 80 are provided to receive hot melt adhesive from the adhesive gun pair 30, 32 and the third adhesive gun 36, respectively. Each slot nozzle assembly 78, 80 applies an elongated ribbon or strip of hot melt adhesive to the end flap structure of sift-proof carton 29 as described in more detail below. In accordance with an important aspect of this invention, both nozzle assemblies 78, 80 include a doctor blade or blades formed with an elongated adhesive discharge slot which contact the end flap structure of a carton to ensure accurate placement of the strips of adhesive.

Referring now to FIGS. 1 and 4, base plate 68 is formed with enlarged bores which receive the fluid tips 82, 84 of adhesive guns 30, 32, respectively. An internal passageway 86 is formed between the fluid tip 82 of adhesive gun 30 and the front face 76 of the base plate 68, which terminates in an outlet port 88 at the front face 76. Similarly, an internal passageway 87 is formed between the fluid tip 84 of adhesive gun 32 and the front face 76 of base plate 68, terminating in an outlet port 89.

Figure 5:
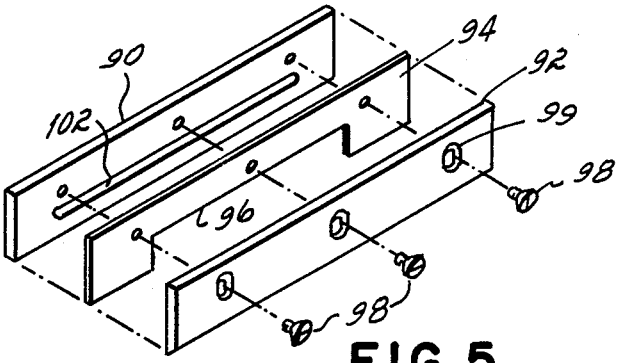
FIG. 5 is an exploded view of the doctor blades shown in FIG. 4.

In one presently preferred embodiment illustrated in FIGS. 4 and 5, the slot nozzle assembly 78 includes a pair of elongated doctor blades 90, 92, in the form of generally rectangular-shaped plates formed of hardened steel such as tool steel, which are separated by a shim 94 formed with a U-shaped cut-out 96. The blades 90, 92 and shim 94 are connected together as a unit by flat head screws 98 which extend through countersunk slots 99 in blade 92 to permit at least some vertical adjustment of blade 92 relative to the shim 94 and blade 90. When connected together, the blades 90, 92 and shim 94 form an elongated fluid discharge slot 100 along the cut-out 96 of shim 94, as shown in FIG. 4. A longitudinal slot 102 is formed in blade 90 having a length at least equal to the U-shaped cut-out 96 in shim 94.

The blades 90, 92 and shim 94 are positioned against the front face 76 of base plate 68 so that the longitudinal slot 102 in blade 90 aligns with the outlet port 88 of inlet passageway 86. An L-shaped clamp 104 is then mounted to the upright leg 72 of base plate 68 by screws 106 to clamp the blades 90, 92 and shim 94 firmly against the front face 76 of base plate 68. Preferably, the clamp 104 is formed with a recess 105 through which the screws 106 pass before being threaded into the upright leg 72 of base plate 68. When the screws 106 are tightened, the center portion of clamp 104 deflects to some degree at the recess 105 which forces the lower portion of the clamp 104 firmly against the blades 90, 92.

Hot melt adhesive therefore flows through the inlet passageways 86, 87 in base plate 68, through their outlet ports 88, 89 and then into the fluid discharge slot 100 formed between the blades 90, 92 via the longitudinal slot 102 in blade 90. The inlet passageways 86, 87 from both adhesive guns 30, 32 ensure a relatively even flow of adhesive along the entire length of the elongated fluid discharge slot 100.

The nozzle assembly 80 of third adhesive gun 36 is identical to nozzle assembly 78 connected to adhesive guns 30, 32, except that the width of the doctor blades 90, 92 is shorter. See FIG. 1. The same reference numerals are therefore used to identify common structural elements of the slot nozzle assembly 80 and slot nozzle assembly 78.

Figure 5A:
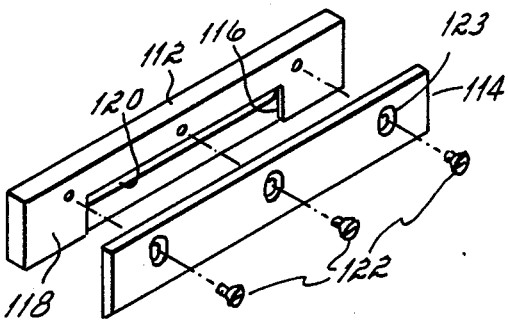
FIG. 5*a* is an alternative embodiment of the doctor blades herein.
Figure 5B:
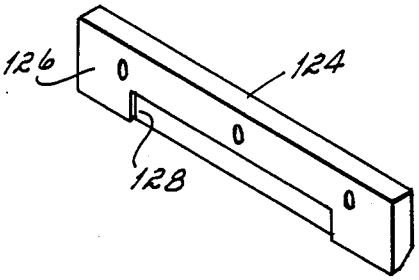
FIG. 5*b* is still another embodiment of the doctor blades herein.

Referring now to FIGS. 5*a* and 5*b*, alternative embodiments of the doctor blades of the nozzle assemblies 78, 80 are illustrated. In FIG. 5*a*, the shim 94 is eliminated and only two blades 112, 114 are provided. A U-shaped cut-out 116 is formed in blade 112 which extends inwardly from its front face 118 to a longitudinal slot 120 formed therein. The blades 112, 114 are secured together by screws 122 extending through countersunk slots 123 formed in blade 114 so that the U-shaped cut-out 118 in blade 112 forms the elongated fluid discharge slot. The blades 112, 114 are mounted to the front face 76 of lower plate 68 by clamp 104 in the same manner as plates 90, 92 with the longitudinal slot 120 in blade 112 positioned in alignment with the outlet ports 88, 89 of passageway 86.

A still further embodiment of the doctor blades herein is illustrated in FIG. 5*b*. In this embodiment, a single blade 124 is formed with a front face 126 and a U-shaped cut-out 128 which extends inwardly from the front face 126. The cut-out 128 defines the fluid discharge slot when blade 124 is clamped against the front face 76 of base plate 68 in the same manner described above.

A construction for adjusting the vertical height of doctor blades is shown in FIG. 4. As there shown, threaded bore 130 is formed in the base plate 68 immediately forwardly of its front face 76, and above the blades 90, 92 and shim 94. The threaded bore 130 receives a set screw 132 which is adapted to engage the top of the blades 90, 92 and is rotatable to push them downwardly for adjustment of their vertical position with respect to the base plate 68. This means of vertical adjustment is also employed when using blades 112, 114 or blade 124.

Figure 6:
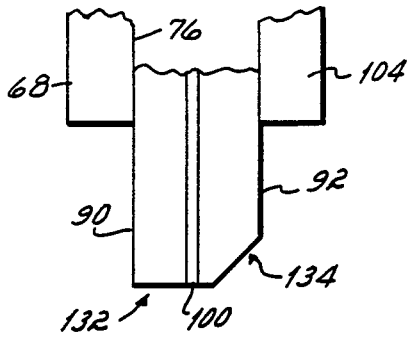
FIG. 6 is an alternative embodiment of the lowermost ends of the blades illustrated in FIG. 5.

The viscosity of hot melt adhesive varies from one type to another. In addition, some applications require adhesive strips of varying thicknesses to achieve the desired bond strength. Referring now to FIGS. 6–6c, various embodiments of the lowermost ends of doctor blades 90, 92, or blades 112, 114, are illustrated which spread the hot melt adhesive discharged onto the substrate as required in a particular application. For example, in FIG. 6 the lowermost end 132 of blade 90 is planar or flat along its entire width, whereas the lowermost end 132 of blade 92 is flat for a short width beginning at the discharge slot 100 and then tapers upwardly at an angle therefrom to its outer edge.

Figure 6A:
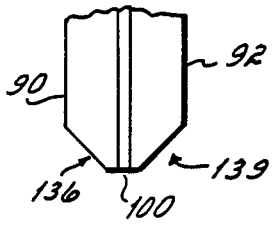
FIG. 6*a* is an alternative embodiment of the lowermost ends of the doctor blades.
Figure 6B:
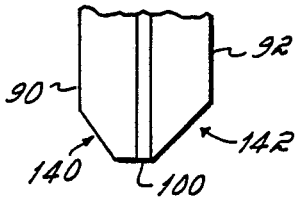
FIG. 6*b* is another embodiment of the lowermost end of the doctor blades herein.
Figure 6C:
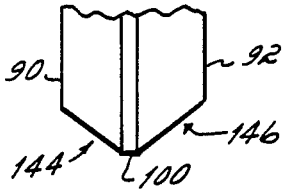
FIG. 6*c* is a still further embodiment of the lowermost ends of the doctor blades.
Figure 6D:
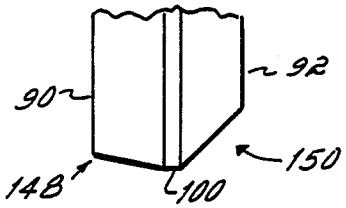
FIG. 6*d* is a still further embodiment of the lowermost ends of the blades herein.

In FIG. 6a, the lowermost ends 136, 138 of blades 90, 92, respectively, are identical to the lowermost end 134 of FIG. 6, except they are mirror images of one another. FIG. 6b illustrates lowermost ends 140, 142 of blades 90, 92 in which end 140 is flat for a short width and then tapers upwardly, while end 142 of blade 92 angles upwardly from its inner edge at the elongated discharge slot 100 to form a pointed end. The lowermost ends 144, 146 of FIG. 6c are mirror images of one another and identical to that of the lowermost end in FIG. 6b. In FIG. 6d, the lowermost end 148 of blade 90 angles upwardly from a pointed edge at the fluid discharge slot 100, as does the lowermost end 150 of blade 92, but the angle at which lowermost end 148 tapers from the discharge slot 100 is more gradual than that of lowermost end 150.

Figure 3:
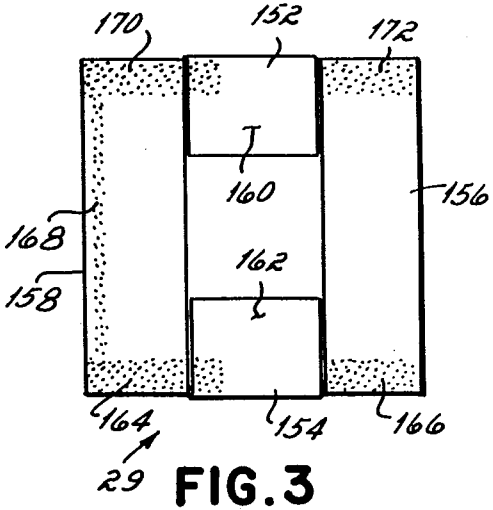
FIG. 3 is a plan view of a four-sided, sift-proof carton and the adhesive pattern applied to its end flap structure by the instant invention.

Referring now to FIGS. 1–3, the operation of the adhesive applicator assembly herein is illustrated in applying hot melt adhesive to the end flap structure of the four-sided, sift-proof carton 29. As schematically illustrated in FIG. 3, the carton 29 includes opposed minor flaps 152, 154, an inner major flap 156 and an outer major flap 158. The major flaps 156, 158 are placed in a spread position relative to the sides of the carton 29 and the minor flaps 152, 154 are folded inwardly forming exposed surfaces 160, 162, respectively.

The carton 29 travels on a conveyor (not shown) along an axis extending perpendicular to the plane of discharge slot 100 in FIG. 1. The first and second adhesive guns 30, 32 operate to provide slot nozzle assembly 78 with adhesive which flows into the discharge slot 100 between blades 90, 92 forming a strip 164 of hot melt adhesive on one end of outer major flap 158 and a portion of the exposed surface 162 of minor flap 154. The third adhesive gun 36 directs adhesive into nozzle assembly 80 and through the discharge slot 100 between blades 90, 92 forming a strip 166 of adhesive on one end of the inner major flap 156. The adhesive guns 30, 32, 36 are then deactivated by the interruption of pilot air supplied by lines 44, 46 when the carton 29 reaches the inner edge of minor flap 154.

As the carton 29 continues moving beneath the applicator body 10, the fourth adhesive gun 38 applies a longitudinal bead or strip 168 of adhesive along a substantial portion of the length of outer major flap 138. As illustrated in FIGS. 1 and 2, adhesive is applied by the fourth adhesive gun 38 directly through its nozzle 40 onto the outer major flap 158.

The first and second adhesive guns 30, 32, and the third adhesive gun 36, are then activated in the identical manner described above to place strips 170, 172, respectively, on the opposite end of the major flaps. The end flap structure of the carton 29 is assembled by first folding the inner major flap 156 onto the minor flaps 152, 154 and then folding the outer major flap 158 over the inner major flap 156.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An applicator for dispensing fluid material onto a substrate, comprising:

an applicator body formed with an internal passageway having an inlet and an outlet;

means connected to a source of fluid material and communicating with said inlet of said internal passageway for directing fluid material from the fluid source into said internal passageway;

blade means including first and second blades at least one of which is formed with a longitudinal inlet slot, and a shim connected between said first and second blades, said shim forming a space between said first and second blades defining a fluid discharge slot therebetween;

clamping means for releasably mounting said blade means to said applicator body so that said longitudinal inlet slot of one of said first and second blades communicates with said outlet of said internal passageway, the fluid material flowing into said internal passageway being directed by said longitudinal inlet slot into said fluid discharge slot of said blade means for application onto the substrate.

2. An applicator for dispensing fluid material onto a substrate, comprising:

an applicator body formed with an internal passageway having an inlet and an outlet;

means connected to a source of fluid material and communicating with said inlet of said internal passageway for directing fluid material from the fluid source into said internal passageway;

blade means including a first blade and a second blade each formed with a planar surface, at least one of said first and second blades being formed with a recess extending from said planar surface thereof inwardly, and at least one of said first and second blades being formed with a longitudinal inlet slot;

clamping means for releasably mounting said first and second blades to said applicator body so that said planar surfaces thereof engage one another with said recess of one of said first and second blades forming a space therebetween defining a fluid discharge slot, and so that said longitudinal inlet slot of one of said first and second blades communicates with said outlet of said internal passageway, the fluid material flowing into said internal passageway of said applicator body being directed by said longitudinal inlet slot into said fluid discharge slot of said blade means for application onto the substrate.

3. The applicator of claims 1 or 2 in which said blade means is formed of hardened steel.

4. The applicator of claims 1 or 2 in which said first blade and said second blade of said blade means each have a lowermost end, said lowermost end of one of said first and second blades being formed with an elongated, flat surface and said lowermost end of the other of said first and second blades being formed with a shortened, flat surface connected to an angled surface.

5. The applicator of claims 1 or 2 in which said first blade and said second blade of said blade means each have a lowermost end, said lowermost ends of said first and second blades each being formed with a short planar surface connected to an angled surface.

6. The applicator of claims 1 or 2 in which said first blade and said second blade of said blade means each have a lowermost end, said lowermost end of one of said first and second blades being formed with a short flat surface connected to an angled surface, and said lowermost end of the other of said first and second blades being formed with an angled surface extending upwardly from a pointed edge at the fluid discharge passageway between said first and second blades.

7. The applicator of claims 1 or 2 in which said first blade and said second blade of said blade means each have a lowermost end, said lowermost end of one of said first and second blades being formed with an angled surface, and said lowermost end of the other of said first and second blades being formed with an angled surface extending upwardly from a pointed edge at the fluid discharge passageway between said first and second blades.

8. The applicator of claims 1 or 2 in which said first blade and said second blade of said blade means each have a lowermost end, said lowermost end of one of said first and second blades being formed at an acute angle tapering upwardly from said fluid discharge slot, said lowermost end of the other of said first and second blades being formed with an angled surface tapering upwardly from said fluid discharge slot at a greater angle than said other lowermost end.

9. The applicator of claims 1 or 2 further including adjustment means for adjusting the vertical position of said blade means with respect to said applicator body.

10. The applicator of claims 1 or 2 in which said applicator body is formed with a threaded bore above said blade means, said applicator further including adjustment means comprising a set screw insertable within said threaded bore and into engagement with said blade means, said set screw being rotatable within said threaded bore to adjust the vertical position of said blade means with respect to said applicator body.

11. An applicator for dispensing adhesive onto the two minor flaps, the inner major flap and the outer major flap of a four-sided, sift-proof carton, the two minor flaps being folded inwardly from a spread position toward the center of the carton forming exposed surfaces and the inner and outer major flaps being disposed in a spread position relative to the sides of the carton, said applicator comprising:

an applicator body;

first, second, third and fourth adhesive guns carried by said applicator body, said adhesive guns being connected to a common adhesive supply passageway formed in said applicator body, each of said adhesive guns communicating with a separate internal passageway formed in said applicator body having an inlet and an outlet, said adhesive body being operable to selectively direct adhesive through said separate internal passageways;

first and second blade means each formed with an elongated fluid discharge slot;

first clamping means for releasably mounting said first blade means to said applicator body so that said fluid discharge slot in said first blade means communicates with said outlet of said internal passageway connected to said first and second adhesive guns;

second clamping means for releasably securing said second blade means to said applicator body so that said fluid discharge slot in said second blade means communicates with said outlet of said internal passageway connected to said third adhesive gun;

said first and second adhesive guns dispensing a strip of adhesive onto each end of the outer major flap, said third adhesive gun dispensing a strip of adhesive onto each end of the inner major flap, and said fourth adhesive gun dispensing an elongated strip of adhesive onto the outer major flap between said strips of adhesive at each end.

* * * * *